United States Patent [19]

Dooley

[11] Patent Number: 4,492,212

[45] Date of Patent: Jan. 8, 1985

[54] INTERNAL COMBUSTION ENGINE OF IMPROVED EFFICIENCY

[76] Inventor: Richard L. Dooley, 921 Maple Ave., Lisle, Ill. 60532

[21] Appl. No.: 406,203

[22] Filed: Aug. 9, 1982

[51] Int. Cl.[3] ..... F02M 29/00

[52] U.S. Cl. ..... 123/590; 123/52 M; 123/52 MB; 48/189

[58] Field of Search ..... 123/590, 591, 52 MB, 123/52 M; 48/189.4

[56] References Cited

U.S. PATENT DOCUMENTS

| | | | |
|---|---|---|---|
| 3,458,297 | 7/1969 | Anderson | 123/590 |
| 3,467,072 | 9/1969 | Toesca | 123/590 |
| 4,019,483 | 4/1977 | Konomi et al. | 123/590 |
| 4,020,805 | 5/1977 | Konomi et al. | 123/590 |
| 4,180,042 | 12/1979 | Lloyd | 123/590 |
| 4,295,458 | 10/1981 | Pellerin | 123/590 |

FOREIGN PATENT DOCUMENTS

| | | | |
|---|---|---|---|
| 991020 | 9/1951 | Italy | 123/590 |
| 539587 | 2/1956 | Italy | 123/590 |
| 550807 | 11/1956 | Italy | 123/590 |
| 2062095 | 5/1981 | United Kingdom | 123/590 |

*Primary Examiner*—Ira S. Lazarus

[57] ABSTRACT

An internal combustion engine of improved efficiency having a cylinder and an intake manifold, the manifold containing therein between the plane of laminated flow and the cylinder end of the manifold a device for increasing turbulence, said device including at least one unit comprising a plate having a central opening which is responsive to flow through said opening to produce turbulence and a second plate having a central opening therein, the plane of the opening in the second plate being downstream of the first mentioned plate. The invention includes also a method for making such an improved engine in which the device is inserted into the cylinder end of the intake manifold until it is fully contained within the manifold.

6 Claims, 6 Drawing Figures

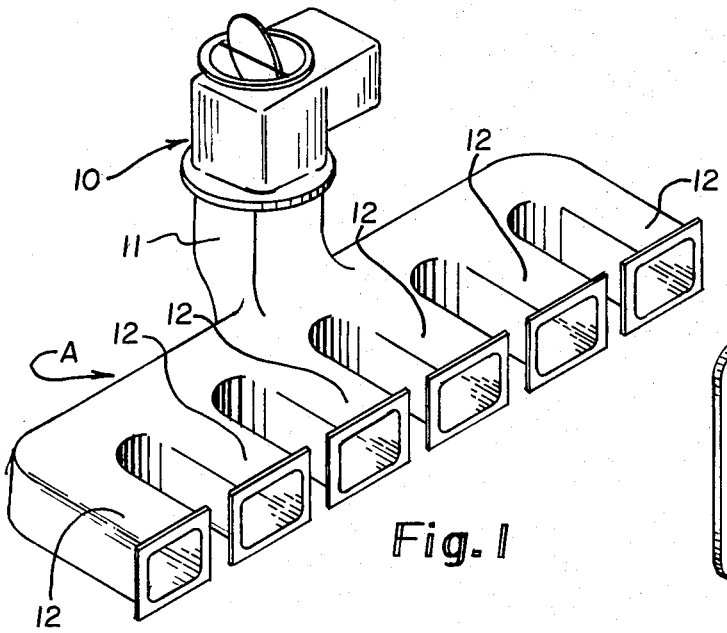
Fig. 1
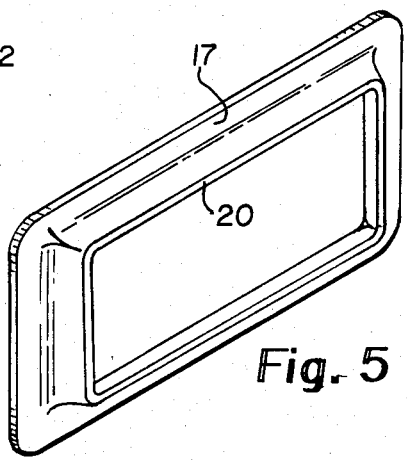
Fig. 5
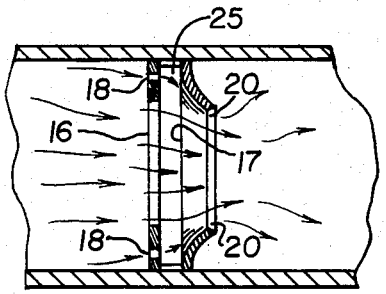
Fig. 6
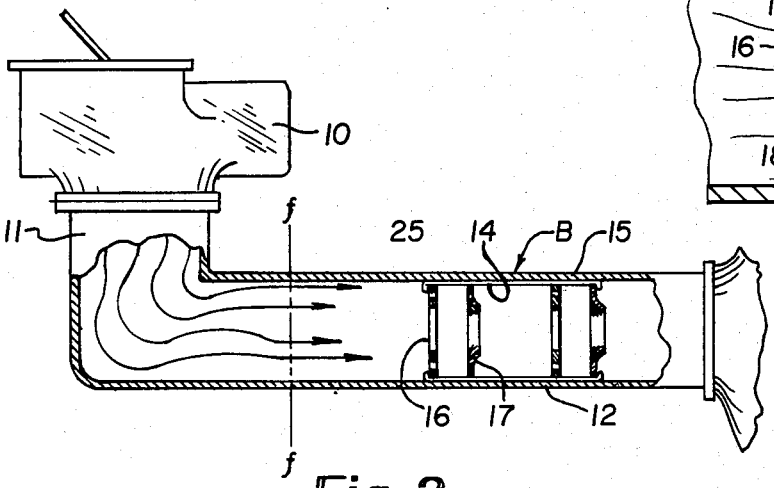
Fig. 2
Fig. 3
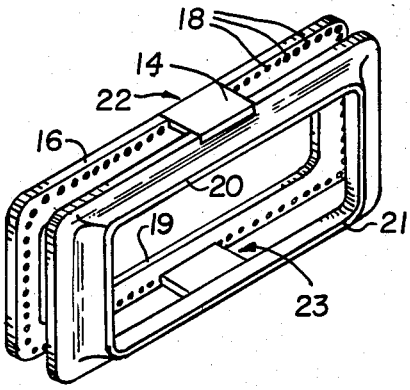
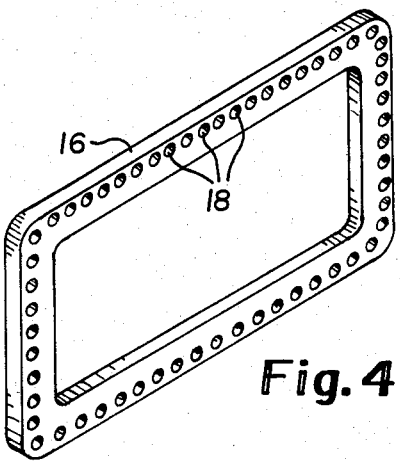
Fig. 4

INTERNAL COMBUSTION ENGINE OF IMPROVED EFFICIENCY

This invention relates to an internal combustion engine and more particularly to an engine in which liquid fuel and air are mixed, the mixture passed through an intake manifold and into the cylinder head of the engine.

BACKGROUND

It has long been the desire of manufacturers of internal combustion engines to improve the efficiency of an engine so that it will produce and deliver greater power and produce more effective work from a given amount of fuel. Many improvements have been made, especially in the carburetion of the fuel and air, and in the conditions for combustion within the cylinders. These improvements have resulted in somewhat greater efficiency which, in the case of an automobile, enable increases in the miles traveled per gallon of gasoline. However, the struggle still goes on, and, in times of fuel shortage, there is a great demand for any improvement which will produce even a slight increase in the mileage obtained.

It is known that during carburetion an intimate vaporous mixture of fuel and air is formed and much effort has been applied to getting a better mixture of fuel and air. In some cases intricate passageways have been provided immediately under or adjacent to the carburetor, the idea being to enhance the fuel and gas mixture delivered by the carburetor. See, for example, U.S. Pat. No. 4,019,476 to Ackley dated Apr. 26, 1979, U.S. Pat. No. 4,180,042 to Lloyd dated Dec. 25, 1979, U.S. Pat. No. 4,177,780 to Pellerin dated Dec. 11, 1979, and U.S. Pat. No. 3,414,242 to Bouteleux dated Dec. 3, 1968.

Other attempts to improve engine efficiency have involved the ignition system, the pressure developed in the cylinder, the length of the piston stroke, the exhaust and other perameters of engine design.

DESCRIPTION

One embodiment of the invention is illustrated in the accompanying drawings in which:

FIG. 1 is a perspective view showing a carburetor to which is attached a common type of intake manifold for a 6 cylinder engine;

FIG. 2 is a view in elevation of one of the passages of the manifold leading from the carburetor to the cylinder head with a part of the manifold wall being broken away to show the baffle structure;

FIG. 3 is a perspective view of one unit of the baffle structure illustrated in FIG. 2;

FIG. 4 is a perspective view of a plate which forms a part of the unit shown in FIG. 3;

FIG. 5 is a perspective view of another of the plates forming the unit shown in FIG. 3; and FIG. 6 is a view of the baffle structure similar to FIG. 2, but showing the general paths taken by the mixture as it passes the baffle structure within the manifold.

As shown particularly in FIG. 1, the illustrated embodiment is for a six cylinder engine. The carburetor 10 serves to produce an intimate mixture of gasoline or other liquid fuel with air, and such mixture, in the form of vapor, passes into the stub 11 of the manifold A. This stub 11 has a relatively large internal cross section and is sometimes called the "log". From the log, which is a single passageway, the intake manifold divides to provide the multiple passageways within the manifold. These separate sections 12, which may be called "finger sections", extend from the log portion of the manifold to the cylinder end of the manifold. There will be one finger section 12 for each cylinder in the engine.

Within the carburetor the fuel and air is mixed and is in a turbulent state, the fuel being broken into fine particles each of which is surrounded by air. The particles are being projected and bombarded by other particles so as to be divided into still smaller particles each surrounded by air. However, as the mixture moves within the intake manifold and moves into the finger sections of the manifold the turbulence of the mixture has waned and is replaced to some extent by slower movement in the finger sections. This is believed to be due, in part, to the tendency of the moving gases to a condition of laminate flow, and also to the frictional contact of the moving gases with the inside surfaces of the manifold. The condition of laminate flow comes to exist after the vapors have traversed the first part of the length of the manifold passage.

In accordance with the present invention I place within the finger sections 12 of the manifold a baffle device B as illustrated in FIGS. 2 to 6. This device, as shown in FIG. 2, contains two units, 14 and 15. Each of these units includes a plate 16 which has its periphery formed to correspond with the cross section of the interior of the finger section. In the center of plate 16 is an opening 19 through which rapidly moving vapors may pass. Plate 16 may contain perforations 18 (See FIGS. 3 and 4). These perforations may also be at the peripheral edges of the plate.

Unit 14 may include a second plate 17 as shown in FIGS. 3 and 5. Plate 17 includes a central opening 20 corresponding with the opening 19 in plate 16. However, the opening 20 in plate 17 is turned forwardly to ease the flow of the vaporous mixture toward the center of the finger section. Plate 17 is preferably spaced from plate 16, but may have its peripheral edge touching or attached to the plate 16.

The plates 16 and 17 may be held and supported by a top strap 22 and a bottom strap 23. When, as shown in FIG. 2, more than one unit is used in any finger section the additional units may be joined in spaced relation by extensions of the straps 22 and 23. I prefer to use as many spaced units as the finger sections of the manifold will physically accomodate.

To install my baffle device in an existing engine I find it convenient to insert one of my baffle devices into the open cylinder end of each of the manifold finger sections. For instance, the two unit device shown in FIG. 2 is inserted into one of the finger sections, another such device is inserted into another finger section, etc., the baffle units being pushed until they are completely contained within the finger section. When the manifold is attached to the cylinder head using appropriate gaskets, the baffle devices, being unable to pass through the gaskets are positively retained within the manifold. If desired, the baffle devices may be pushed further back within the manifold and held there by frictional contact with the manifold wall. We are here dealing only with an intake manifold and there will be no pressure tending to blow the baffle devices back toward the carburetor end of the manifold. However, nothing of importance may be expected to be gained by placing the baffle devices upstream of the plane of laminate flow as described hereinabove.

I will now describe how I believe the invention operates and the theory which I believe best explains the very satisfactory results which are obtained, but no disclaimer of any part of the invention is made in the event that such results are better explained on any different theory.

When the fuel and air mixture comes from the carburetor and enters the inlet end of the intake manifold this mixture is in a wild state of turbulence and this turbulence continues until the mixture has traveled a distance up to the plane of laminate flow as previously described. In FIG. 2 of the drawing this plane of laminate flow is indicated at the line f—f. At this plane the bombardment of the fuel particles comes to be abated as the particles proceed at a high rate of speed in nearly parallel paths longitudinally of the manifold. Fuel particles which contact each other are understood to merge so that the number of fuel particles surrounded by air is decreased. Heavier particles may move out of the main stream near the wall of the manifold. The character of the vaporous mixture is believed to be quite different from the boistrous mixture entering the intake end of the manifold.

When the vaporous mixture reaches the plate 16 of the first baffle unit (See FIG. 6) the relatively fast moving vapor at the center of the manifold passageway moves through central opening 19 past the edges 24 of this opening it is atomized and caused to create a vacuum forward of plate 16, which vacuum draws the heavier and slower moving fuel particles which are caught back of plate 16, and pulls these heavier portions through perforations 18 into the turbulence caused to exist in the area 25 between plates 16 and 17. The particles in the center of the stream along with those drawn through perforations 18 then move forwardly in a turbulent state in the center stream through the central opening 20. Thus the turbulence and the bombardment of fuel particles is revived and/or enhanced without increasing substantially back pressure which would cut down the flow.

Such action is repeated when the vaporous mixture reaches and passes through the second and subsequent baffle units which are placed within the manifold. In this way the vigor and character of the vaporous mixture is revived and enhanced when it is passed into the cylinder head and into the cylinder where it is caused to undergo combustion.

An object of the invention is to control and to improve the fuel to air ratio and the character of the fuel-air mixture at the time it is being passed into the cylinder head. According to this invention this is accomplished by placing within the intake manifold, preferably near the cylinder end of the manifold, a baffle structure which operates to increase the turbulance of the fuel-air mixture. This tends to increase the number of fuel particles without any corresponding increase in the amount of air, thus producing a finer and more intimate mixture which passes to the cylinder of the engine.

I have already described how the baffle device may be placed within the intake manifold of an existing motor. Such a baffle device may also be placed within the intake manifold of new engines in the course of their manufacture and may be secured to the walls of the manifold in any suitable way.

To test the results obtained by use of the improved intake manifold containing the baffle device, I selected a 1968 Ford Falcon station wagon, standard shift, 3 speed engine, 289 cu. in., 8 cylinder. The car weighed approximately 3700 lbs.

In preparation for the test I procured a one gallon bottle. I checked the bottle and marked it accurately so that when filled with gasoline to the mark it contained exactly one gallon of gasoline.

I tested the odometer of the car against the road markers on route U.S. 55 and U.S. 80, finding that the odometer checked with the road signs (within 0.1 of a mile in 10 miles).

The pattern of the test was to run the car in a suburban area of Chicago before the installation of my baffle device, and determine the distance traveled until the one gallon bottle was empty, and from this to calculate the miles per gallon. Then two units of my baffle device was installed in the cylinder end of each of the eight inlet manifold tubes. After this the same tests as above described were run under the same conditions using a regular grade of gasoline from the same source as was used for the first series of tests. The results of the tests are as follows:

| | |
|---|---|
| Suburban driving without the use of the baffle device | |
| At the beginning of the test the odometer read: | 19603.2 |
| and at the end of this test read: | 19618.1 |
| which I calculated to be 14.9 miles/gal. | |
| Highway driving without the use of the baffle device | |
| At the beginning of the test the odometer read: | 19692.4 |
| and at the end of this test read: | 19779.1 |
| which I calculated to be 18.3 mi./gal. | |
| Suburban driving with the use of the baffle device | |
| At the beginning of the test the odometer read: | 19730.8 |
| and at the end of the test read: | 19749.2 |
| which I calculated to be 18.6 mi./gal | |
| Highway driving with the use of the baffle device | |
| At the beginning of the test the odometer read: | 19757.1 |
| and at the end of the test read: | 19779.1 |
| which I calculated to be 22.3 miles/gal. | |

To test what the effect would be to add additional units of the baffle device I removed the intake manifold and removed the two baffle units in each finger section, replacing the two baffle units in each finger section with four baffle units. The intake manifold, modified in this way, was reinstalled in the engine, and the same type of tests under the same conditions as before. The following results were obtained:

| | |
|---|---|
| Suburban driving using 4 baffle units in each finger section | |
| At the beginning of the test the odometer read: | 28262.5 |
| and at the end of the test read: | 28285.7 |
| which I calculated to be 23.2 miles per gal. | |
| Highway Driving using 4 baffle units in each finger section | |
| At the beginning of the test the odometer read: | 28321.4 |
| and at the end of the test read: | 28348.1 |
| which I calculated to be 26.7 miles per gal. | |

While in the foregoing description I have described in detail one embodiment of the invention it is apparent that other embodiments may be constructed, and that many changes may be made all within the spirit of the invention and the scope of the appended claims.

I claim:

1. In an internal combustion engine having a plurality of cylinders, a carburetor and a manifold, said manifold having a log section adapted to receive fuel-gas mixture from said carburetor, and a plurality of finger sections each being connected independently to said log section to receive fuel-gas mixture from said log section and being adapted to pass fuel-gas mixture forwardly to the end of the finger section, the improvement comprising a baffle device located within one of said finger sections and between the place of beginning laminate flow and the outlet end of said finger, said device including a pair of plates each of which has a central opening therein and the second of which is disposed downstream of said first plate, said plates forming between them an area wholly within said finger section and containing fuel-gas mixture in a turbulent state.

2. An internal combustion engine as set forth in claim 1 and in which one of said baffle devices is contained in each of said finger sections.

3. An internal combustion engine as set forth in claim 1 and in which a plurality of said devices is contained in said one finger section, one of said devices being located downstream of another of said devices.

4. A method for assembling an internal combustion engine having a carburetor and a log section into which fuel-gas mixture from the carburetor is passed and having finger sections which are adapted to receive fuel-gas mixture separately from said log section and through which the fuel-gas mixture passes to the outlet end of the finger sections, the step of inserting into said outlet of a finger section a device having a pair of spaced plates having central openings therein until said device is wholly contained within said one finger section.

5. A method as set forth in claim 4 which includes inserting one of said devices into the exhaust end of each of said finger sections and pushing each of said devices into the finger sections until they are each wholly contained within the finger sections.

6. A method as set forth in claim 5 which includes the step of passing fuel-gas mixture from said carburetor through said log section and through each of said finger sections while said devices are contained within said finger sections.

* * * * *